United States Patent [19]

Monser

[11] 4,132,995

[45] Jan. 2, 1979

[54] CAVITY BACKED SLOT ANTENNA

[75] Inventor: George J. Monser, Goleta, Calif.

[73] Assignee: Raytheon Company, Lexington, Mass.

[21] Appl. No.: 846,740

[22] Filed: Oct. 31, 1977

[51] Int. Cl.[2] ..... H01Q 1/28; H01Q 13/18

[52] U.S. Cl. ..... 343/767; 343/789

[58] Field of Search ..... 343/705, 708, 767, 768, 343/769, 789

[56] References Cited

U.S. PATENT DOCUMENTS 2,885,676 5/1959 Baldwin ..... 343/767

*Primary Examiner*—Eli Lieberman

*Attorney, Agent, or Firm*—Richard M. Sharkansky; Joseph D. Pannone

[57] ABSTRACT

A radio frequency antenna having a flared, discontinuous slot formed on one surface of a dielectric support structure and a feed formed on the opposite surface of such structure. The feed is disposed across a narrow portion of the slot. A housing having a cavity formed therein is provided. The dielectric support is disposed on the housing over the cavity. The cavity has a conductive wall, or deflective plate, disposed beneath a wide portion of the slot. The effects of the feed and the slot-deflection plate combine to provide a flush-mountable antenna having a cardioid-shaped radiation pattern.

8 Claims, 6 Drawing Figures

CAVITY BACKED SLOT ANTENNA

BACKGROUND OF THE INVENTION

This invention relates generally to radio frequency antennas and more particularly to flush-mountable radio frequency antennas.

As is known in the art, it is frequently desirable to provide a radio frequency antenna which occupies minimum space and is essentially flush-mountable to a carrier vehicle, such as an aircraft. As is also known in the art, a radio frequency antenna which is adapted to provide a cardioid-shaped radiation pattern is useful in many applications, for example, where each one of a pair of antennas is mounted to an opposite side of such vehicle, thereby enabling such pair of antennas to be used in a "left/right" amplitude sensing system. While many antennas, such as annular slot and cavity-backed spiral antennas, may be flush-mounted to such a vehicle, such antennas do not produce the cardioid-shaped radiation patterns necessary for the "left/right" amplitude sensing systems, and while other antennas, such as a loop monopulse antenna, provide the cardioid-shaped radiation pattern, such antennas are not flush-mountable and also have relatively low gain.

SUMMARY OF THE INVENTION

With this background of the invention in mind it is therefore an object of this invention to provide a relatively small, flush-mountable radio frequency antenna adapted to provide a cardioid-shaped radiation pattern which is substantially independent of frequency over a relatively wide band of frequencies.

This and other objects of the invention are attained generally by providing a radio frequency antenna comprising a dielectric support structure having a conductive sheet formed on one side thereof, such conductive sheet having a flared, discontinuous notch formed therein; a feed for coupling radio frequency energy across the narrow portion of the flared notch; and a housing having a cavity formed therein, the dielectric support structure being mounted to the housing to form a cover for the housing, a conductive deflection plate forming a second surface of such housing, such deflection plate being disposed at an acute angle with the dielectric support structure and beneath the wide portion of the flared slot.

In a preferred embodiment of the invention the dielectric support structure is a planar substrate and the deflection plate makes a forty-five degree angle with respect to the plane of the support, thereby producing a cardioid-shaped radiation pattern normal to the plane of the substrate. Further, a third surface of the housing is disposed orthogonal to the plane of the substrate, providing a reflecting edge across the narrow portion of the flared slot.

BRIEF DESCRIPTION OF THE DRAWINGS

The foregoing features of this invention, as well as the invention itself, may be more fully understood from the following detailed description read together with the accompanying drawings, in which.

DESCRIPTION OF THE PREFERRED EMBODIMENT

Figure 1:
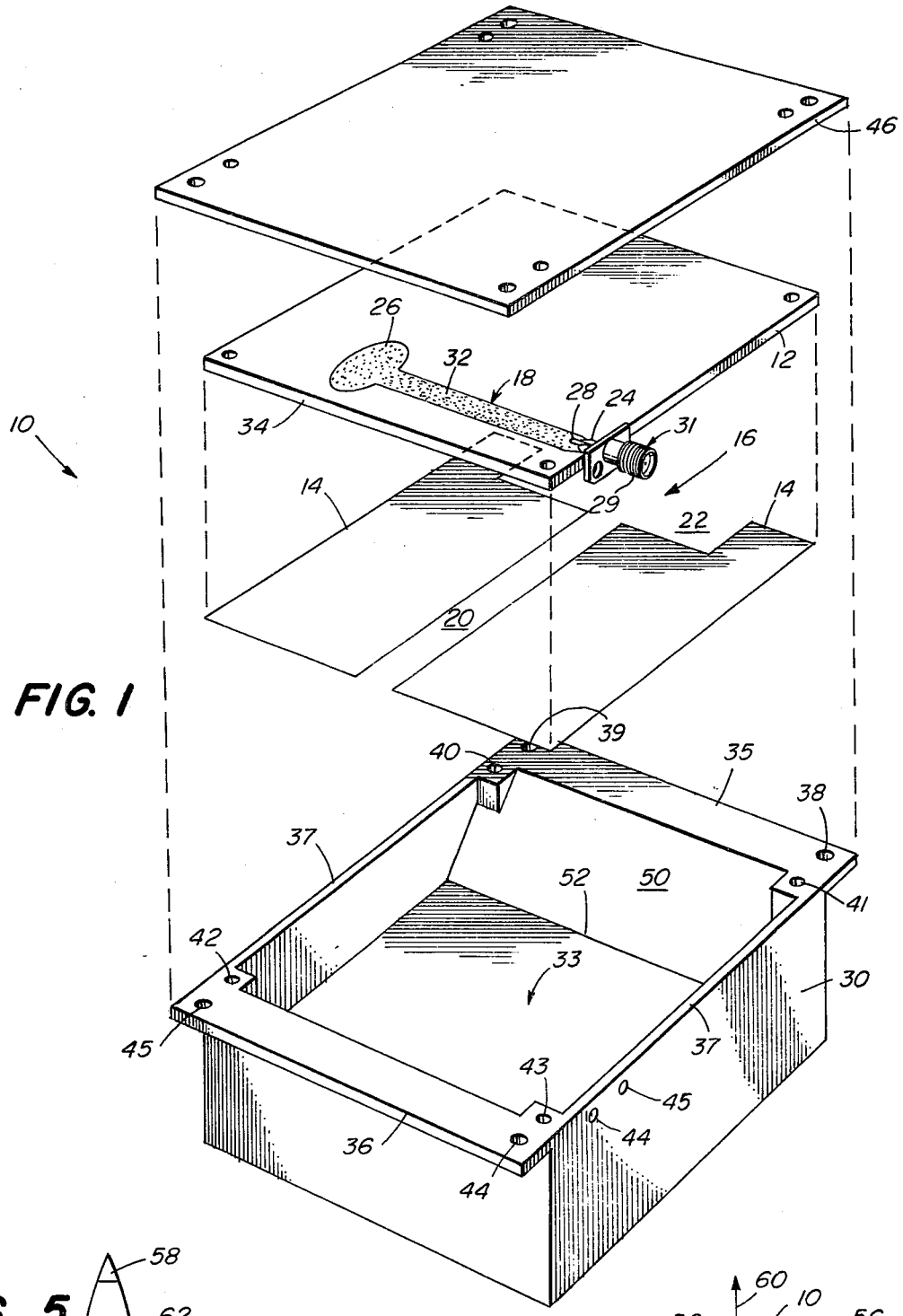
FIG. 1 is an exploded isometric drawing, somewhat simplified, of an antenna element according to the invention.
Figure 3:
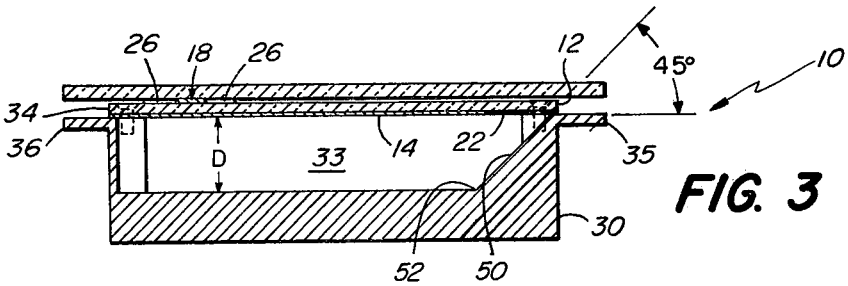
FIG. 3 is a cross-sectional elevation view of the antenna element shown in FIG. 2, taken along line 3—3.
Figure 2:
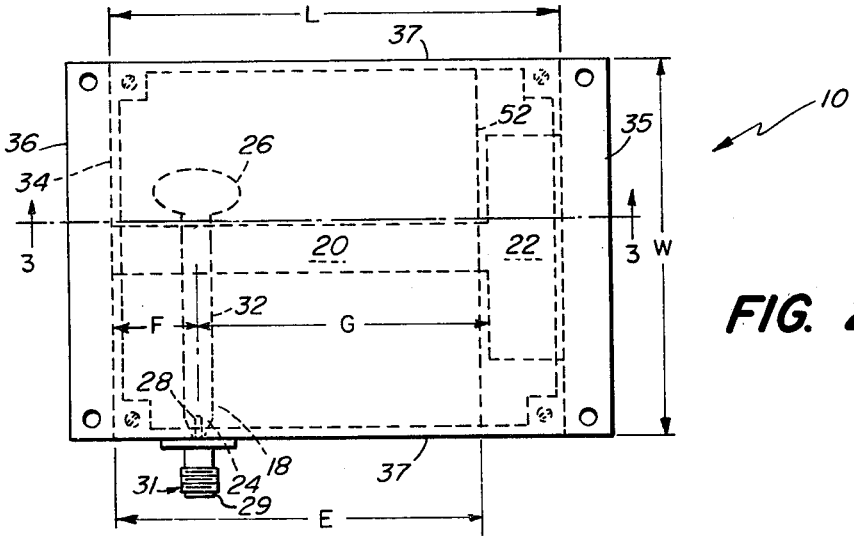
FIG. 2 is a plane view of the antenna element shown in FIG. 1.

Referring now to FIGS. 1, 2 and 3, a relatively small, flush-mountable radio frequency antenna element 10 is shown. Such antenna element is adapted to provide a cardioid-shaped radiating pattern over a relatively wide, here over an octave, frequency band. The antenna element 10 includes a dielectric support structure 12, here a planar dielectric substrate of Teflon-Fiberglas material 1/16th inch thick and having a dielectric constant of 2.54. Such dielectric support structure 12 has a thin conductive sheet 14, here copper, plated on one of the planar surfaces of the dielectric support structure 12, such conductive sheet 14 having a flared discontinuous slot 16 formed therein, as shown, using conventional photolithography. Formed on the opposite planar surface of the dielectric support structure 12 is a conductive feed 18, here copper, such feed 18 also being formed, as shown, using conventional photolithography. The narrow portion 20 of flared slot 16 has a width, here 5/16 inch, and the wide portion 22 of such slot has a width, here 1.5 inches. The length, L, of the dielectric support structure 12 is here 3.0 inches and the width, W, of such dielectric support structure is here 2.5 inches. The length of the wide portion 22 of flared slot 16 is here 0.5 inch. The feed 18 includes a triangular-shaped input section 24 at one end and an elliptically-shaped matching section 26 at the other end as shown. Connected to the apex of the triangular-shaped input section 24 is the center conductor 28 of coaxial connector 31. The center conductor 28 is electrically connected to the apex of the triangular-shaped input section 24, here by solder, not shown. The outer conductor 29 of the coaxial connector 30 is electrically connected to the conductive sheet 14, here by solder, not shown. The outer conductor 29 of the coaxial connector 31 is electrically connected to the conductive sheet 14, here by solder, not shown. The altitude of the triangular-shaped input section 24 is here 3/16 inch. The central portion 32 of the feed 18 here has a width 3/16 inch and a length 1.125 inches. The elliptically-shaped matching section 26 has a major axis, here $\frac{5}{8}$ inch, and a minor axis, here 5/16 inch. The apex of the triangular-shaped input section 24 is here $\frac{5}{8}$ inch from the back edge 34 of the dielectric support structure 12. The central portion 29 of the feed 18 extends from the input section 24 to the matching section 26 parallel to the back edge 34 and is disposed orthogonal to the major axes of the elliptically-shaped matching section 26.

The antenna element 10 includes a conductive housing 30, here an aluminum block having a cavity 33 formed therein using conventional machining techniques. The housing 30 has a pair of mounting flanges 35, 36 and a mounting edge 37 which is disposed about the periphery of the cavity 33, as shown. Drilled and tapped holes 38, 39, 40, 41, 42, 43, 44 and 45 are formed in the housing, as shown, using conventional processes. Holes 40, 41, 42 and 43 are used to fasten the dielectric support structure 12 and a cover 46, here made of Teflon-Fiberglas having a dielectric constant of 2.54, to the housing 30 using conventional screws, not shown. Holes 44, 45, also drilled and tapped, are provided for the coaxial connector 31. When assembled the edges of the conductive sheets 14 are in electrical and mechanical contact with the edge 37 (including mounting flanges 35, 36) formed about the periphery of the cavity 33. It is noted, therefore, that a portion of such mounting edge 37 (i.e. a portion of flange 36) provides an electrical connection or short circuit across the narrow portion 20 of the slot 16 formed along the back edge 34 of the dielectric support structure. A deflection plate 50 is machined into the housing 30 to form one surface of the cavity 33. Such deflection plate 50 makes an acute angle with the dielectric support structure 12, here a 45 degree angle, as shown. The deflection plate 50 is disposed beneath the wide portion 22 of the slot 16, as shown. In particular, the edge 52 of the deflection plate 50 extends parallel to the back edge 34 of the dielectric support structure 12 and such edge 52 is displaced from such back edge 34 a length, E, here in the order of 2.4 inches. The depth of the cavity, D, is here 0.5 inch.

Figure 5:
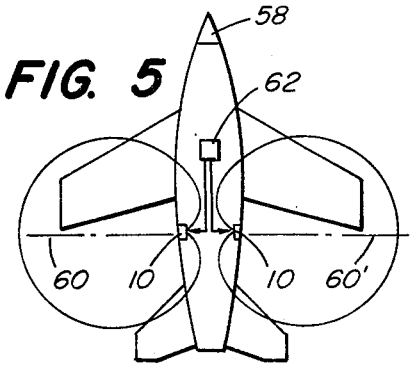
FIG. 5 is a sketch of an aircraft having a pair of antenna elements of FIG. 1 for use in an amplitude sensing system.
Figure 4:
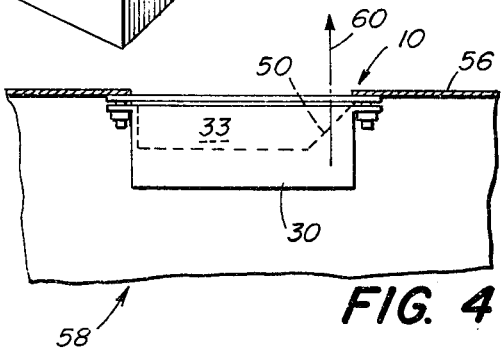
FIG. 4 is a cross-sectional elevation view, greatly simplified and somewhat distorted, of the antenna element of FIG. 1 shown mounted in a vehicle.

It is noted that, when assembled, the antenna element 10 is a box-shaped structure having an outside depth of about 0.75 inch. Such antenna element 10 is flush-mountable within the metal conductive surface 56 of a vehicle 58 (FIGS. 4 and 5). The boresight axis 60 of the antenna element 10 is orthogonal to the planar surface of the antenna element 10 (i.e. orthogonal to the planar surfaces of the dielectric support structure 12) as shown in FIG. 4. The conductive surface 56 of the vehicle 58 provides a finite ground plane for the antenna element 10.

In operation, and considering transmit while recognizing that the antenna element 10 may be used during receive because of principles of reciprocity, radio frequency energy, here having a frequency within the band 1.0–2.0 GHz, is introduced into the feed 18 via coaxial connector 31 (FIGS. 1, 2 and 3).

Figure 6:
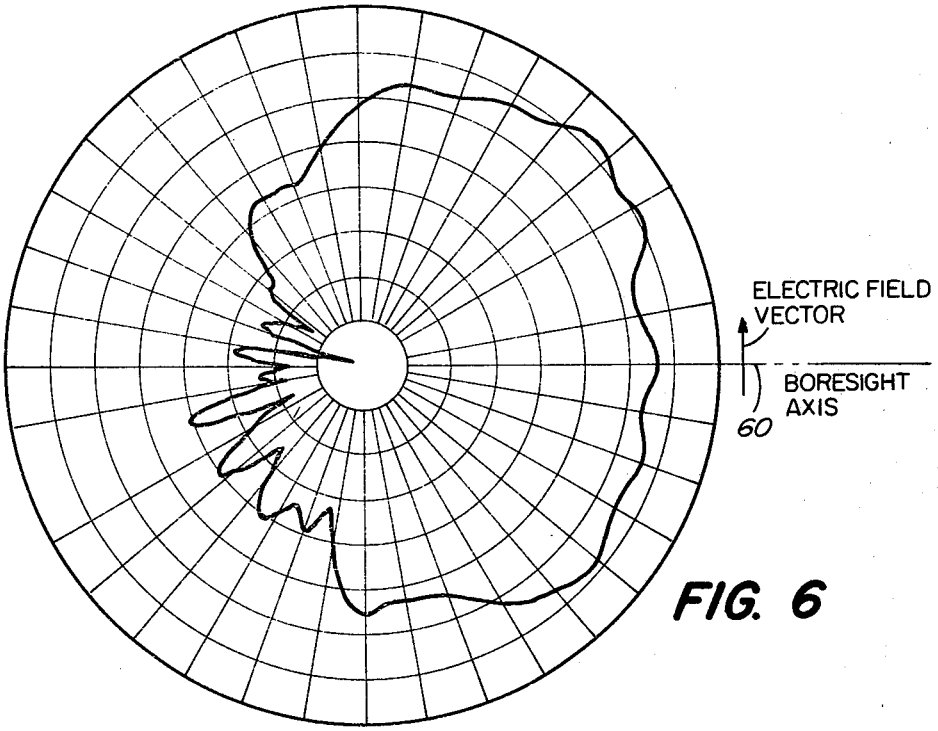
FIG. 6 shows a typical radiation pattern.

It is noted that the narrow portion 20 of the slot 16 is short-circuited along the back edge 34 of the dielectric support structure 12 by a portion of the mounting flange 36 of the conductive housing 30 whereas at the discontinuity in the slot 16 (i.e. the place where the slot 16 changes from the narrow portion 20 to the wide portion 22) there is an "open circuit" across the slot 16. The feed 18 is positioned between the back edge 34 and the discontinuity. The distance F between the back edge 34 and the feed 18 is here 17/32 inch and the distance G between the feed 18 and the discontinuity is here 1-31/32 inches. The dimensions F and G are selected so that the impedance presented to energy introduced by feed 18 favors propagation and radiation from the wide portion 22. That is, energy introduced into the antenna element 10 by the feed 18 then "sees" less impedance in propagation to the wide portion 22 of the slot 16 than in propagating to the back edge 34. Consequently, such energy is, in substance, directed toward the wide portion 22 of the slot 18 rather than toward the back edge 34. The energy which is directed to the wide portion 22 of the slot 16 is therefore radiated into cavity 52 because of the discontinuity of the slot 16 (i.e. the discontinuous change in the width of slot 16 from its narrow portion 20 to its wide portion 22). The radiated energy is reflected by the deflection plate 50 to propagate along the direction of boresight axis 60 as shown in FIG. 4. The electric field component of such radiated energy is parallel to the feed line 18 and the plane of the support 12. It is also noted that the feed 18 radiates energy along the direction of boresight axis 60 because such feed 18 may be considered as a monopole radiating element where the bottom portion of the cavity substantially serves as a reflector for such monopole radiating element. The electric field component of this radiated energy is also parallel to the feed 18 and the plane of the support 12. The time delay caused by the separation between the feed 18 and the discontinuity in the slot 16 causes a phase difference between the fields radiated by such feed 18 and the slot 16. The electrical length separating the feed 18 and the discontinuity is less than $\lambda c/2$ where $\lambda c$ is the nominal operating, free space, wavelength of the antenna element 10. Preferably such electrical length is in the order of $\lambda c/4$. Here the separation between the feed 18 and the discontinuity in the slot 16 is in the order of $\lambda c/4$ where $\lambda c$ is 7.866 inches. The vectorial addition of the fields radiated by the slot 16 (and deflected by the deflection plate 50) and radiated by the feed 18 results in antenna 10 producing a cardioid-shaped radiation pattern. A typical radiation pattern for such antenna element 10 is shown in FIG. 6. Such pattern is measured in a plane orthogonal to the support structure and parallel to the feed 18. It is noted that such radiation pattern is cardioid-shaped. Referring to FIG. 5, a pair of antenna elements 10 is shown mounted to opposite sides of an aircraft 58 for use in a left/right amplitude sensing system 62. It is noted that the antenna elements 10 are flush-mounted with the metal conductive surface 56 of the vehicle 58 (FIG. 4) and further that because the antenna elements 10 are grounded to the conductive surface of the aircraft 58, such antenna elements 10 are not subject to damage from lightning discharges.

Having described a preferred embodiment of this invention, it is now evident that other embodiments incorporating these concepts may be used. For example, while a printed circuit feed 18 has been shown, a coaxial feed may be used with the center conductor being connected to one portion of the conductive sheet 14 and the outer conductor being connected to the other portion of such sheet 14, such connections being made across the narrow portion 20 of the slot 16. Further, while antenna element 10 having a rectangular-shaped radiating surface has been described, such antenna element may be another geometric shape, such as a circularly-shaped radiating surface, in which case the deflection plate would be arcuate-shaped. Still further, the antenna elements may be used in a phase sensing system as where each one of a pair of such elements is mounted on opposite wings of an aircraft. It is felt, therefore, that this invention should not be restricted to the disclosed embodiment, but rather should be limited only by the spirit and scope of the appended claims.

What is claimed is:

1. A radio frequency antenna, comprising:

(a) a dielectric support structure;

(b) a conductive sheet having a flared, discontinuous slot formed therein, such slot being disposed on one surface of the support structure;

(c) a feed for coupling radio frequency energy across a narrow portion of the flared slot; and (d) a housing having: a cavity with conductive walls formed therein, the dielectric support structure being mounted to the housing to provide a cover for such cavity; and a deflection plate forming a wall of such cavity, such deflection plate being disposed at an acute angle with respect to the dielectric support structure and beneath a wide portion of the slot.

2. The radio frequency antenna recited in claim 1 wherein the dielectric support structure is planar and the deflection plate makes a forty-five degree angle with the plane of the support.

3. The radio frequency antenna recited in claim 1 wherein a conductor is disposed across the narrow portion of the slot.

4. The radio frequency antenna recited in claim 3 wherein the feed is disposed between the conductor and a discontinuity region of the slot.

5. The radio frequency antenna recited in claim 4 wherein the feed is formed on a surface of the support structure.

6. The radio frequency antenna recited in claim 1 wherein the feed is displaced from the discontinuity region a length less than $\lambda c/2$ when $\lambda c$ is the nominal operating wavelength of the antenna.

7. The radio frequency antenna recited in claim 6 wherein the feed is displaced from the discontinuity a length in the order of $\lambda c/4$.

8. A radio frequency antenna comprising:

(a) a dielectric support structure having: a conductive sheet with a flared, discontinuous slot therein, such slot being formed on one surface of the structure; and a feed formed on the opposite surface of the support, such feed being disposed across a narrow portion of the slot; and (b) a housing having a cavity formed therein, the dielectric support being disposed over the cavity, such cavity having a conductive wall disposed beneath a wide portion of the slot.

* * * * *